United States Patent [19]

Drosdick

[11] Patent Number: 4,589,938

[45] Date of Patent: May 20, 1986

[54] SINGLE PHASE COPPER-NICKEL-ALUMINUM-ALLOYS

[75] Inventor: Joseph W. Drosdick, Clinton, N.Y.

[73] Assignee: Revere Copper and Brass Incorporated, Stamford, Conn.

[21] Appl. No.: 631,359

[22] Filed: Jul. 16, 1984

[51] Int. Cl.[4] ..... C22C 9/06

[52] U.S. Cl. ..... 148/435; 148/436; 148/11.5 C; 420/473; 420/479; 420/486; 420/487

[58] Field of Search ..... 420/486, 487, 473, 479; 148/435, 436, 11.5 C

[56] References Cited

U.S. PATENT DOCUMENTS

| | | | |
|---|---|---|---|
| 1,916,602 | 7/1933 | Braddock | 420/486 |
| 2,031,315 | 2/1936 | Jennison | 420/486 |
| 2,031,316 | 2/1936 | Jennison | 420/471 |
| 2,061,897 | 11/1936 | Crampton | 420/471 |
| 2,798,826 | 8/1957 | Klement | 148/13 |
| 3,725,056 | 4/1973 | Ingerson | 420/471 |
| 4,401,488 | 8/1983 | Prinz et al. | 420/486 |
| 4,402,906 | 9/1983 | Ueda et al. | 420/493 |

FOREIGN PATENT DOCUMENTS

| | | | |
|---|---|---|---|
| 137449 | 8/1982 | Japan | 420/473 |

OTHER PUBLICATIONS

LL-C1 Interim Data Sheet, Kennecott Copper Corp.
Data Sheet for Alloy 644, Anaconda American Brass.
Metals Handbook, 8th ed. vol. 8, pp. 388-389 (1973).

*Primary Examiner*—Veronica O'Keefe
*Attorney, Agent, or Firm*—Pennie & Edmonds

[57] ABSTRACT

Novel gold colored copper alloy compositions of single phase crystal structure possessing a combination of good cold and hot workability, excellent ductility and excellent corrosion, pitting, and tarnishing resistance. The compositions contain between about 0.5 and 4 weight percent nickel, between about 0.5 and 3.8 weight percent aluminum, and up to about 1.3 weight percent iron with the balance being copper. Additions of up to 0.5 weight percent, of manganese, silicon, zinc, tin lead, individually or any combination thereof, also contribute to or maintain the improved properties of the present invention. Other aspects of the invention relate to a method for imparting the above-described properties to a copper alloy, the non-tarnishing pitting resistant, gold colored sheets strip, wire, and like products made from such compositions, and an articles suitable for use as architectural members, jewelry, electrical connectors or heat exchanger/condenser tubing stock.

15 Claims, No Drawings

SINGLE PHASE COPPER-NICKEL-ALUMINUM-ALLOYS

TECHNICAL FIELD

The present invention relates to novel nickel and aluminum bearing copper alloy compositions having a single phase crystal structure that possess high oxidation resistance coupled with high tensile strength and ductility. The specific alloying elements used in these compositions provide good corrosion resistance, particularly against pitting and tarnishing, impart an attractive gold luster, and create a bronze alloy with good strength and excellent hot and cold working characteristics.

BACKGROUND ART

As a material of construction, copper and copper alloys constitute one of the major groups of commercial metals. Copper alloys, varying in composition to meet the requirements of specific applications, are widely used due to their excellent electrical and thermal conductivity, good corrosion resistance, adequate strength and ease of fabrication.

Aluminum-bronze alloys have taken a predominant position in construction applications because aluminum has been shown to be a highly effective element in enhancing the alloy's casting property, tensile strength and overall resistace to intergranular oxidation. Alloys of aluminum and copper are categorized in two commercially important types, the single-phase alpha solid solution alloys and the alpha-beta alloys.

Solubility limitations dictate that under equlibrium conditions, 9.8 weight percent aluminum is soluble in copper before the beta phase forms. In commercial nonequilibrium conditions, however, copper alloys containing in excess of 7.5 weight percent aluminum exhibit a two phase structure. Alpha phase alloys have excellent working properties and can be readily fabricated into tube and sheet plate. The commercially important aluminum bronzes contain 4–10% aluminum often in combination with other metals.

The annealing characteristics of alpha alloys resemble those of the well-known alpha brasses whereby annealing can be performed over a wide range of temperatures, from 430°–760° C. depending on desired properties. Aluminum-bronze alloys exhibit improved oxidation resistance at elevated temperatures than other copper-base alloys. Resistance toward oxidation, increasing with aluminum content, appears to be largely attributable to formation of aluminum oxide on the exposed surfaces.

This aluminum oxide film is resistant to most acid catalyzed attack and is distributed on the alloy surface to provide excellent resistant to smog catalyzed oxidation cased by urban nitrogen dioxide and sulfur dioxide. Furthermore, the addition of aluminum to copper tends to form a self-healing alloy surface film thereby substantially increasing the alloy's resistance toward impingement damage.

The structure and consequent heat treatability of aluminum bronze alloys appear to vary greatly with composition. For example, single phase alpha aluminum bronzes that contain only copper and up to 10% aluminum can be strengthened only by cold working and can be softened by annealing at 425° to 760° C.

Although single-phase binary alloys such as aluminum bronze 5% (95 weight percent copper, 5 weight percent aluminum) cannot be age hardened, the addition of particular elements such as cobalt and nickel produces alloys that are age hardenable.

Commercial aluminum-bronze alloys are designated by the Unified Numbering System (UNS) by numbers C60600 to C64200. The various coppers within this group have varying aluminum contents and consequently possess slightly different properties. All of these alloys, however, are primarily designed for applications requiring good corrosion-resistance and some examples follow.

Aluminum bronze 5%, C60800, used for condenser tubing, has a nominal composition, of 95 weight percent copper and 5 weight percent aluminum. This alloy exhibits good cold workability, fair hot formability and provides good corrosion resistance.

Lusterloy, designated C61500, possesses composition limits (weight percent) of 89.0 to 90.5 copper, 7.7 to 8.3 aluminum, 1.8 to 2.2 nickel and 0.015 lead, maximum. This alloy has a gold color and is typically used in decorative trim, architectural panels and tarnish-resistant articles. C61500 is characterized as exhibiting excellent corrosion resistance and good formability.

C63600, typically used for bolts, screw machine products and products requiring cold working, has composition limits (weight percent) of 93.5 to 96.3 copper; 3.0 to 4.0 aluminum; 0.7 to 1.3 silicon; and a maximum of 0.50 zinc; 0.20 tin; 0.15 nickel; 0.15 iron and 0.50 lead. C63600 is not recommended in applications requiring soldering, brazing and oxyfuel gas welding.

C63800, commonly known as Coronze, exhibits crevise corrosion resistance far superior to most other copper alloys. Coronze, exhibiting more resistance to stress corrosion than the nickel silvers, has composition limits (weight percent) of 93.5 to 96.3 copper; 3.0 to 4.0 aluminum; 0.7 to 1.3 silicon; and a maximum of 0.50 zinc; 0.20 tin; 0.15 nickel; 0.15 iron; and 0.05 lead. This alloy is typically used in springs, contacts, glass sealing and porcelain enameling.

There are certain disadvantages in using these prior art alloys. Alloys containing low proportions of aluminum do not develop the required proof stress and tensile strength when produced by standard hot working processes. Furthermore, it is generally accepted by those skilled in the art that in order to achieve the best combination of properties in copper-nickel-aluminum alloys, the ratio of nickel to aluminum should be in the region of 5:1.

It is known that copper alloys with an aluminum content of less than one-sixth of the nickel content result in an alloy possessing considerably higher ductility although proof stress and tensile strength are usually reduced. U.S. Pat. No. 3,399,057 discloses a cupronickel alloy composition which contains (by percent weight): 15–32% nickel, 1.5–3% aluminum, 4–6% manganese, 0.5–2% iron, and balance copper. While this patent does yield copper alloy compositions exhibiting higher ductility, this improvement is obtained at a loss of proof stress and tensile strength.

An aluminum-bronze alloy for a welding rod is disclosed in U.S. Pat. No. 2,430,419. This alloy contains 3 to 15 weight percent aluminum; 0.1 to 5 weight percent iron; 0.1 to 6 weight percent nickel; 0.1 to 6 weight percent manganese and balance substantially all copper. The iron stabilizes the alloy and reduces the rate of reactions when passing through critical temperatures and the like. The entire composition range of this alloy does not have a single phase structure, and thus provide more difficult working characteristics. Also, since alloying elements are often lost or volatized during welding processes, the preferred compositions of this patent utilizes the higher end of the disclosed alloying additions to compensate for such loss.

Therefore, none of the prior art discloses copper-nickel-aluminum alloy compositions that exhibit high ductility, reasonably high tensile strength, a broad range of fabricating options, a single phase structure, excellent corrosion resistance and the desired gold-like color, while capable of being made at low cost from scrap of rework materials.

DISCLOSURE OF THE INVENTION

The present invention relates to compositions, methods, products and apparatus of copper-nickel-aluminum alloy compositions which exhibit excellent pitting corrosion resistance, improved mechanical properties and equal or better casting and working abilities when compared to conventional alloys.

The compositions of the present invention contain a novel and unique combination of copper, nickel, and aluminum which imparts the desired properties to these alloys. Also, small amounts of additional elements such as iron, manganese, silicon, zinc, tin, and lead can be included in these compositions to provide equal or better results.

While the additions of various elements to aluminum is conventional, the combination and interaction of the selected elements in the particular ranges claimed is not conventional. Consequently, these novel alloys possess a gold-like color, excellent pitting corrosion resistance, and increased mechanical properties over prior art compositions when manufactured or processed by conventional methods.

A further advantage of the present invention is that it can tolerate certain levels of impurities which may result from manufacturing operations without adversely affecting the improved pitting corrosion resistance or increased mechanical properties. This allows the new compositions to be optionally manufactured from scrap metal using lower cost conventional techniques rather than by special techniques to maintain very low residual impurity levels.

SUMMARY OF THE INVENTION

Specifically, one aspect of the invention relates to comprises copper base alloy compositions that contain from about 0.5 to 4 weight percent nickel, about 0.5 to 3.8 weight percent aluminum and the balance being essentially copper.

Iron in up to 1.3 weight percent may also be present in these alloys. Iron stabilizes the alloy and reduces the rate of the reactions when passing through critical temperature ranges encountered during hot-working or heat treating operations.

Intentional or impurity additions of up to 0.5 weight percent manganese, silicon, zinc, tin, lead, or combinations of these elements also maintain or do not detract from the improved properties of this invention over the prior art.

While the iron and other alloying additions do not have to be intentionally added to the compositions of this invention, they are usually present in trace amounts, particularly when the alloy is made from scrap or rework material. Also, the total amount of all other residual or impurity elements in the claimed compositions should be less than 0.5 weight percent, because it is important for the alloy to have a copper base of at least about 88 percent by weight in order to achieve a single phase crystal structure.

In these compositions the preferred ranges for nickel and aluminum are 3.5–4 and 3.3–3.8, respectively, because alloying element additions on the higher end of the claimed ranges provide optimum physical properties while still maintaining the necessary single phase crystal structure.

Another aspect of the invention relates to a method for imparting a gold-like color to a copper alloy which comprises adding a sufficient amount of nickel and copper to provide a single phase crystal structure. As mentioned above, this crystal structure allows the resultant alloy to possess high strength, excellent ductility, and improved resistance to pitting corrosion or tarnishing.

Advantageously, the nickel and aluminum contents can range within the same limit as for the previously described compositions. Again, a sufficient amount of iron, preferably up to about 1.3 weight percent, can be added to stabilize the alloy. Also, the same comments regarding residual or impurity elements also apply to the compositions used in this method.

A further aspect of the invention relates to the gold-colored alloys produced by the preceding method.

The invention also contemplates non-tarnishing, pitting resistant gold-colored copper alloy sheet strip, wire, tube, and like products comprising sufficient amounts of nickel and aluminum in a copper alloy to provide a single phase crystal structure in the alloy. Again, it is the combination of alloying elements and single crystal structure which provide the improved color, corrosion resistance, strength, and ductility properties of the alloy.

Another aspect of the invention relates to an apparatus for use in jewelry or as architectural members, appliance parts, electrical connectors, or heat exchanger tubing stock which is comprised of the copper alloy compositions described hereinabove.

EXAMPLE

The scope of the invention is further described in connection with the following example which are set forth for purposes of illustration only and are not to be construed as limiting the scope of the invention in any manner.

A preferred composition of the invention was prepared by conventional techniques. Analysis revealed the follow composition (weight percents):

| | |
|---|---|
| Copper | 90.7 |
| Nickel | 4.0 |
| Aluminum | 3.8 |
| Iron | 1.1 |
| total other elements | 0.4 |

The test samples were buffed and appeared bright and shiny without first utilizing an intermediate anneal.

Physical testing of this alloy determined the following properties

| | |
|---|---|
| Ultimate Tensile Strength | 68.7 ksi |
| Elongation | 13% |
| Ultimate Tensile Strength (40% cold worked) | 103.7 ksi |
| Elongation | 7% |

-continued

| |
|---|
| (40% cold worked) |

These results show a surprisingly high tensile strength for the alloy while still maintaining relatively high elongation.

The single alpha phase structure of the instant invention imparts favorable physical attributes not limited to high tensile strength, high elongation, excellent cold workability, good hot workability and excellent corrosion-erosion resistance.

The physical attributes of the alloys disclosed in this invention will lend themselves to a myriad of end uses not limited to architectural applications such as roofs, sheets and hand rails; jewelry; consumer products; heat exchangers, condensers and electrical applications.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

I claim:

1. A copper alloy composition consisting essentially of nickel in an amount above 0.5 and less than 4 weight percent; aluminum in an amount above 0.5 and less than 3.8 weight percent; iron in an effective amount to stabilize the alloy during hot working or heat treating operations up to about 1.3 weight percent; and less than 0.5 weight percent of one or more of manganese, silicon, tin, zinc, and lead; with the balance being at least about 88 weight percent copper; said composition having a single phase crystal structure.

2. The composition according to claim 1 wherein the iron content is between about 1.1 and 1.3 weight percent.

3. The composition of claim 1 wherein the nickel content ranges from about 3.5 to less than 4 weight percent, the aluminum content ranges from about 3.3 to less than 3.8 weight percent, and the iron content ranges between about 1.1 and about 1.3 weight percent.

4. A copper alloy composition consisting of nickel in an amount above about 0.5 and less than 4 weight percent; aluminum in an amount above about 0.5 and less than 3.8 weight percent; iron in an amount between about 1.1 and 1.3 weight percent; less than 0.5 weight percent of one or more of manganese, silicon, tin, zinc and lead; and copper in an amount of at least about 88 weight percent; said composition having a single phase crystal structure.

5. The composition of claim 4 wherein the nickel content ranges from about 3.5 to less than 4 weight percent and the aluminum content ranges from about 3.3 to less than 3.8 weight percent.

6. A method for imparting a gold color to a copper alloy which comprises mixing into copper above 0.5 and less than 4 weight percent nickel; above 0.5 and less than 3.8 weight percent aluminum; and iron in an amount sufficient to stabilize the alloy during hot working or heat treating operations up to about 1.3 weight percent to provide an alloy having a copper content of at least about 88 weight percent and a single phase crystal structure, said structure providing high strength, excellent ductility, improved pitting and tarnishing resistance, and a gold color.

7. The method according to claim 6 which further comprises mixing into said composition an amount of up to about 0.5 weight percent of at least one of the elements selected from the group consisting of manganese, silicon, zinc, tin, and lead.

8. The method according to claim 6 wherein the iron content is between about 1.1 and 1.3 weight percent.

9. The gold-colored copper alloy of single phase crystal structure produced in accordance with the method of claim 6.

10. The gold-colored copper alloy of single phase crystal structure produced in accordance with the method of claim 7.

11. The gold-colored copper alloy of single phase crystal structure produced in accordance with the method of claim 8.

12. Non-tarnishing, pitting resistant, gold-colored copper alloy sheet, strip, wire, tube, and like products comprising the copper alloy of claim 1 having a single phase crystal structure, said crystal structure providing the previously-described properties along with good strength and excellent ductility.

13. Non-tarnishing, pitting resistant, gold-colored copper alloy sheet, strip, wire, tube, and like products comprising the copper alloy according to claim 4, said alloy having a single phase crystal structure which provides the previously-described properties along with good strength and ductility.

14. An article suitable for use in jewelry or as architectural members, appliance parts, electrical connectors, or heat exchanger/condenser tubing stock which is comprised of a copper alloy composition according to claim 1 and which is further rolled, cut, stamped, formed, machined, or otherwise fabricated into a desired shape.

15. An article suitable for use in jewelry or as architectural members, appliance parts, electrical connectors, or heat exchanger/condenser tubing stock which is comprised of a copper alloy composition according to claim 4 and which is further rolled, cut, stamped, formed, machined, or otherwise fabricated into a desired shape.

* * * * *